United States Patent [19]

Meyer

[11] 4,207,862

[45] Jun. 17, 1980

[54] FIREPLACE COOKING RANGE AND ROOM AIR HEATER

[76] Inventor: Walter W. Meyer, 14151 75th Ave. N.E., Bothell, Wash. 98011

[21] Appl. No.: 848,401

[22] Filed: Nov. 4, 1977

[51] Int. Cl.[2] ..... F24B 1/26

[52] U.S. Cl. ..... 126/137; 126/6; 126/123; 126/140

[58] Field of Search ..... 126/137, 123, 126, 140, 126/202, 120, 121, 4, 6, 301, 315, 318

[56] References Cited

U.S. PATENT DOCUMENTS

| | | | |
|---|---|---|---|
| 722,029 | 3/1903 | Mann | 126/318 |
| 1,470,542 | 10/1923 | Polinc | 126/137 X |
| 2,814,287 | 11/1957 | Shults | 126/140 |
| 3,616,788 | 11/1971 | Hannebaum | 126/140 X |
| 3,986,488 | 10/1976 | Hannebaum | 126/137 X |
| 4,026,264 | 5/1977 | Henrigues | 126/126 X |

FOREIGN PATENT DOCUMENTS

| | | | |
|---|---|---|---|
| 14892 | of 1884 | United Kingdom | 126/137 |
| 4502 | 1/1916 | United Kingdom | 126/137 |
| 875001 | 8/1961 | United Kingdom | 126/120 |

*Primary Examiner*—Albert J. Makay
*Assistant Examiner*—Harold Joyce
*Attorney, Agent, or Firm*—Roy E. Mattern, Jr.

[57] ABSTRACT

A fireplace cooking range and room air heater, in one embodiment installed in a conventional fireplace and in another embodiment freely standing, has: a bottom fire chamber; a cooking range-air heater having a spaced porous grill and spaced above the bottom fire chamber, surrounding walls extending up from the fire chamber and spaced about surface structures of the cooking range-air heater and then converging for exiting the combustion gases into a flue; a flue for carrying the combustion gases out of a dwelling; non-combustible sealing material, as necessary, positioned about the flue to prevent room air from escaping up and around the exterior of the flue; entry doors to close the cooking range-air heater at its room side; entry doors to close the fire chamber at its room side; a room air intake located below the entry doors of the cooking range-air heater and at the top of the fire chamber; and a draft regulator to control the quantity of room air flowing through the room air intake, then flowing down inside of the closed entry doors to the fire chamber, thereby keeping soot and other particles from collecting on the inside surfaces of the closed entry doors, which are often made of tempered glass so the fire may be observed and enjoyed.

1 Claim, 5 Drawing Figures

FIREPLACE COOKING RANGE AND ROOM AIR HEATER

BACKGROUND OF THE INVENTION

As indicated in James Seymour's U.S. Pat. No. 317,863 issued in 1885, the utilization of a fireplace for both cooking and heating room air has been previously undertaken. Also Thomas Carter in 1920 in his U.S. Pat. No. 1,352,048, and M. E. Poling in his U.S. Pat. No. 1,470,542 in 1923, both disclosed structural additions made to otherwise open fireplaces, both to heat room air and to create a chamber in which cooking and baking were undertaken.

However, there remains today still a need for structural additions and/or free standing structures having improvements beyond those of the past, so the heating of a dwelling may be undertaken more efficiently, while providing the facilities for cooking and baking in a fireplace.

SUMMARY OF THE INVENTION

When wanted an improved fireplace cooking range and room air heater is installed in a home in either a free standing embodiment, or in an embodiment for placement in an otherwise open fireplace. In either embodiment, a limited and controllable amount of room air is withdrawn to support the combustion of the fireplace fuel, and this room air is drawn in through an intake located just above the entry doors providing access to a fire chamber. In either embodiment a cooking range-air heater with entry doors is spaced above the fire chamber and the exterior of its bottom, sides, and top are exposed to the exiting combustion gases enroute from the fire chamber to a flue. In either embodiment, the flue provided for directing the combustion gases upwardly and beyond the dwelling is arranged so no room air will depart alongside the exterior of the flue, flexible non-combustible materials, such fiberglass mats, being used around flues extending up into the chimneys of otherwise open fireplaces. Also in either embodiment, a draft regulator controls the quantity of room air flowing through the intake located just above the entry doors to the fire chamber. The room air, after entry, flows downwardly along the inside surfaces of the closed entry doors of the fire chamber, thereby preventing soot and other particles from collecting on the entry doors. When these doors are made of tempered glass and so remain clear of soot, the fire may be readily observed and enjoyed.

DESCRIPTION OF THE DRAWINGS

The two embodiments of the fireplace cooking range and room air heater are illustrated in the drawings, wherein.

DESCRIPTION OF THE PREFERRED EMBODIMENTS

Introduction to the Embodiments

Figure 1:
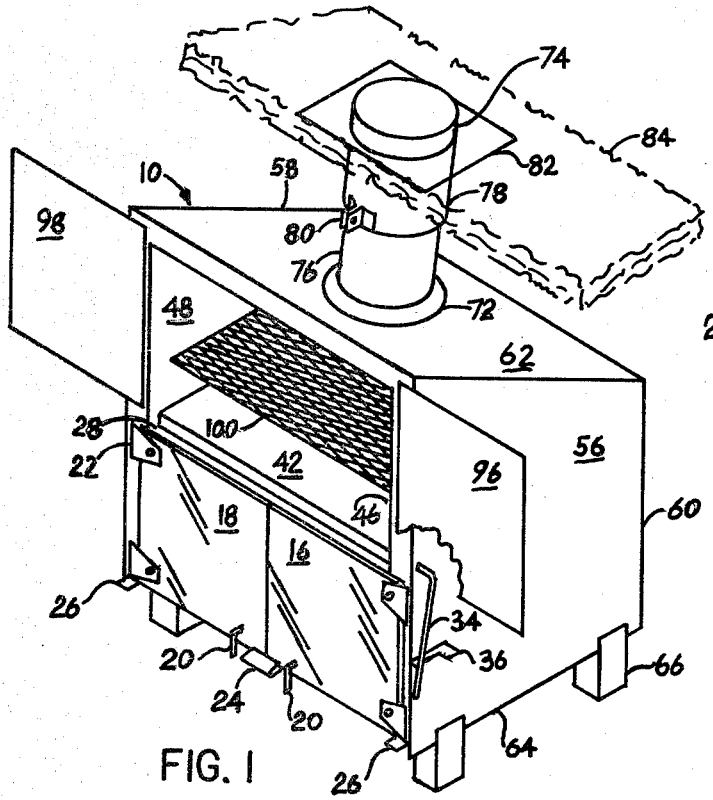
FIG. 1 is a perspective view of a fireplace cooking range and room air heater before its installation into a conventional fireplace with a portion of an open cooking range door broken away to illustrate the handle and its stop used in positioning the room air intake draft regulator, and with flexible heat resisting material shown in broken lines indicating its placement about a flue in the chimney of a conventional fireplace.
Figure 3:
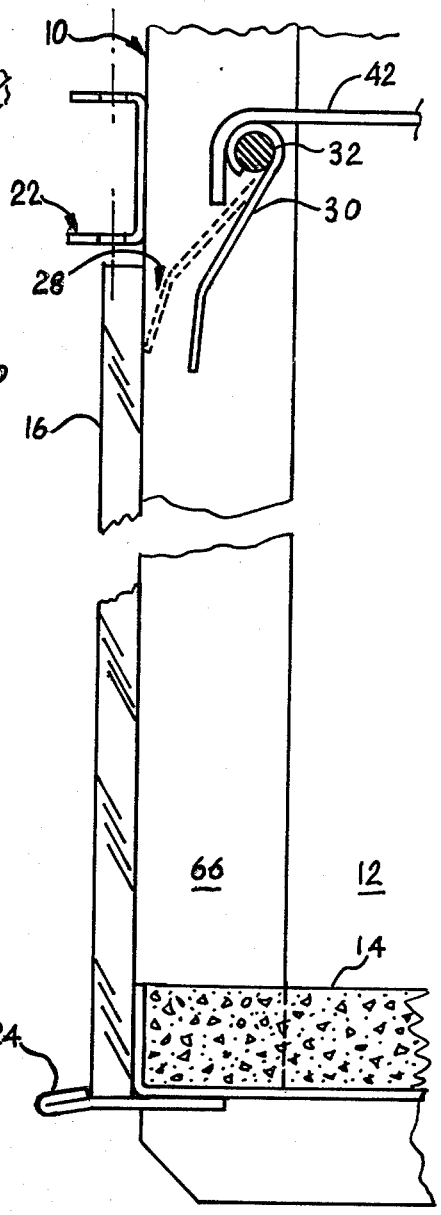
FIG. 3 is a partial cross-sectional view of the fire chamber and the entry doors thereof and also the draft regulator controlling the intake of room air, indicating in dotted lines its closed position.
Figure 2:
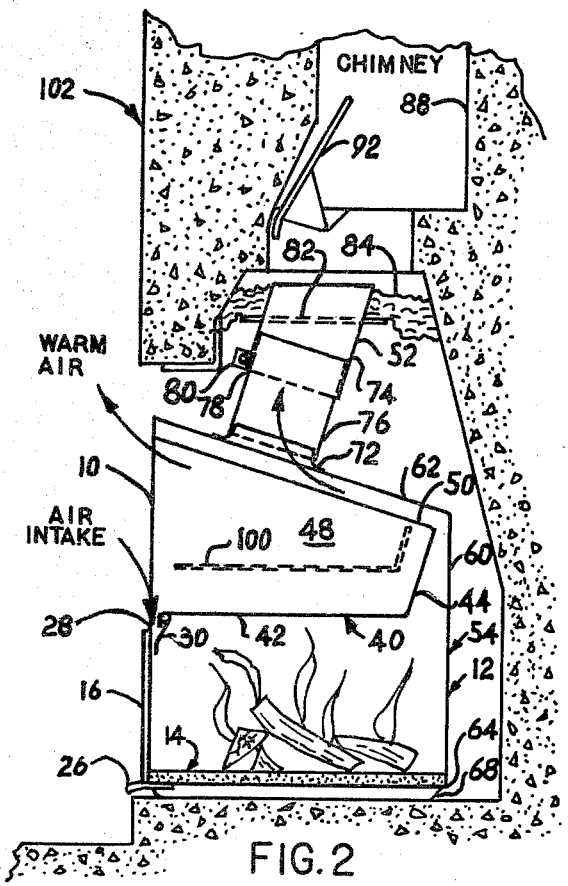
FIG. 2 is a partial cross-sectional view of a conventional fireplace and chimney with the fireplace cooking range and room air heater installed and operating, directional arrows indicating the room air flows and also the exhaust gas and smoke flows up the flue and into the chimney.
Figure 4:
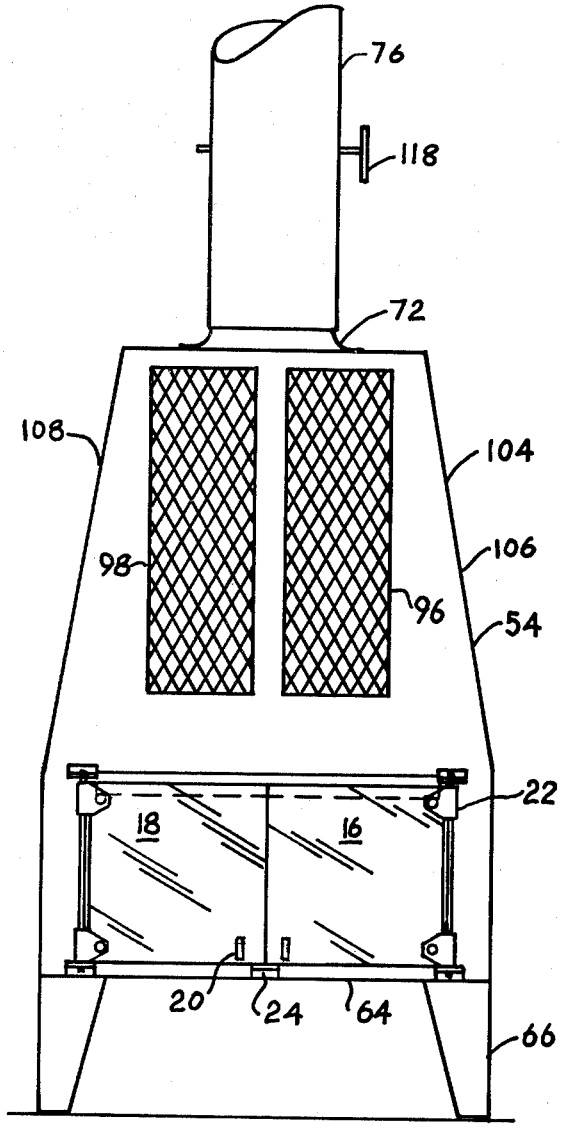
FIG. 4 is a front view of a fireplace cooking range and room air heater which is free standing, with only portions of the flue being shown to indicate the location of the draft regulator.
Figure 5:
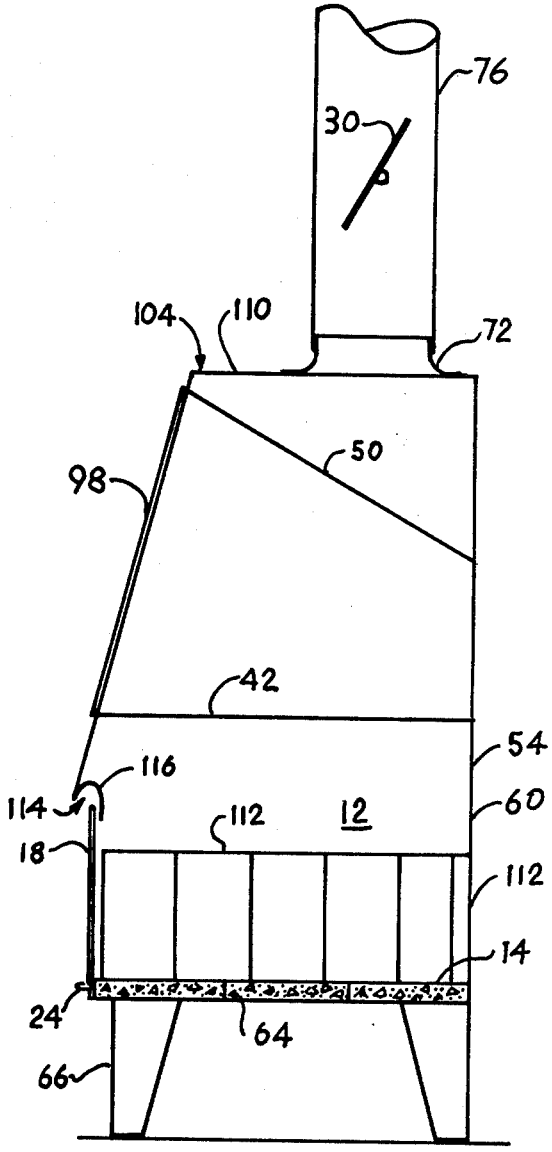
FIG. 5 is a side view, with portions removed, of the free standing fireplace and cooking range and room air heater illustrated in FIG. 4, to indicate both the room air intake location and the draft regulator location in reference to the positions of both the lower fire chamber and the higher cooking range-air heater.

The two embodiments of the fireplace cooking range and room air heater, i.e. the embodiment of FIGS. 1, 2 and 3 installed in a conventional fireplace, and the free standing embodiment of FIGS. 4 and 5, have the like features of: a lower fire chamber; a higher cooking range-room air heater positioned so most of its exterior surfaces are exposed in a heat exchange relationship to the flue smoke and gases; the heat transfer-support grill in the cooking range-room air heater; and the room air intake located just below the cooking range-room air heater and at the top of the entry doors of the fire chamber, whereby using a draft regulator, the room air is continuously drawn in and downwardly across the inside of the entry doors and then toward the fire, such downwardly flow keeping the inside surfaces of the entry doors, often made of tempered glass, clear of soot, smoke, and any other residue, which otherwise would obscure the view of the fire.

Fireplace Cooking Range and Room Air Heater for Installation in a Conventional Fireplace In FIGS. 1, 2 and 3, the fireplace cooking range and room air heater 10 for installation in a conventionl fireplace 11 is illustrated. The lower fire chamber 12 has: a stainless steel reinforced refractory bottom liner 14; entry doors 16, 18, with handles 20, preferably made of tempered glass, with their hinge pins, not shown, rotatably and slidably held in hinge bracket assemblies 22, capable of vertical latching movement in respect to the bottom catch 24 and door guides 26; a room air intake 28; and a pivotal room air draft regulator 30 secured to a cross-supporting shaft 32, in turn moved by an exterior handle 34, which is pivoted from a draft closed position to an open draft position at stop bracket 36.

A cooking range-air heater 40 is spaced above this lower fire chamber 12 and its bottom 42, sloping back 44, sides 46, 48, and sloping top 50 are all on their exteriors exposed, in a heat transfer relationship, to the combustion gases and smoke enroute to the flue assembly 52.

The exiting combustion gases and smoke are so directed to pass by these outer portions of the cooking range-air heater 40, as a result of the positioning of the surrounding walls 54, of the cooking range and room air heater 10, which are spaced apart from the cooking range-room air heater 40. These surrounding walls 54, which are spaced apart, are the sides 56, 58, the back 60, and sloping top 62, and they are supported via the bottom 64. All of these structures collectively determine the exterior of the surrounding walls 54, which in this embodiment, is the overall exterior of the cooking range and room air heater 10. Where needed throughout the surrounding walls 54, interior frame members 66 are used.

Respective required installation heights are obtained by the selection of legs 66 of a particular height, or alternately by using spaced rib supports 68. Selective overall flue lengths are obtained by using an adjustable flue assembly 52, which includes the flue exit opening flange 72, telescoping flue conduit sections 74, 76, tightened together at a selected length by using a surrounding clamping band 78, in turn secured by its fastener assembly 80. The selected length of the overall flue assembly 52 is determined, as illustrated in FIG. 2, so it will extend vertically up through a flexible heat resisting material 84, which in turn is positioned on a supporting flange 82 of the flue assembly 52 and then extended horizontally throughout the chimney cross-sectional area which is outside of the flue conduit 74. This heat resisting material 84 creates an air seal preventing heated room air from escaping up through the chimney 88. Before this air seal installation is made, any existing fireplace damper 92 is secured in an open position, and the air flow is thereafter controlled by using the draft regulator 30.

The cooking range-air heater 40 is supported at the forward end of its bottom 42 by the supporting shaft 32, in turn rotatably supported by the sides 56, 58, of the surrounding walls 54. In addition the cooking range-air heater 40 is supported by spacer supports, not shown, to maintain the heat exchanger spaces, through which the exiting gases and smoke flow enroute to the flue assembly 52. During cooking and baking operations, entry doors 96, 98 are closed and the interior temperatures become very high in the cooking range-heater 40. During room air heating periods, entry doors 96, 98 are opened and the interior temperatures are lower. In respect to cooking and baking, an open grill 100 is secured to the sides 46, 48 and it receives heat, holds heat, and transfers heat to cooking utensils, not shown, placed thereon, during operations of the cooking range-air heater 40.

As so assembled and installed in a conventional fireplace 102 and chimney 88, this fireplace range and room air heater 10 makes it possible to enjoy a fire while optionally heating room air and/or cooking or baking. In so doing the otherwise larger losses of heated room air, known to be lost when a conventional fireplace is being used, are substantially reduced. By use of tempered glass doors, and other decorative door and frame finishes, this fireplace range and room air heater 10, is a beautiful as well as practical addition to any home.

A Free Standing Fireplace Cooking Range and Room Air Heater

In many homes, there are no fireplaces or there are free standing metal fireplaces. In these homes the free standing fireplace cooking range and room air heater 104 as illustrated in FIGS. 4 and 5, either provides the first fireplace for a home or a substitute for the existing free standing metal fireplace. Many of the components are essentially the same as in the first embodiment except for their proportions; therefore in FIGS. 4 and 5 like reference numbers are used to identify these components. Only where there are other differences are other numbers used and the differences are correspondingly explained.

In respect to these differences, because the fireplace cooking range and room air heater is free standing and therefore completely visible in a room, the side walls 106, 108 of the surrounding walls 54 are tapered inwardly as shown in FIG. 4. Also the top 110 is not sloping so items may be placed thereon and kept warm. No grill is shown but one could be utilized. Upstanding refractory blocks 112 are placed along the sides 106, 108 and back 60 of the surrounding walls, where they determine the lower fire chamber 12. The back of the cooking range-air heater 40 is shown as being a portion of the back 60 of the surrounding walls 54.

The room air draft entry 114 is non-adjustable and its curved deflector 116 is utilized to direct the incoming room air down along the inside surfaces of the entry doors 16, 18, preferably made of tempered glass. The draft regulator 30 in the flue 76, is rotated by turning handle 118 to control the flow of the room air through the draft entry 114.

This free standing fireplace cooking range and room air heater 104 excellently produces heat for cooking and baking and/or heating the room, and does so with the comparatively minimum use of room air serving as draft air. Because of the controlled flow of the incoming room air draft, the tempered glass entry doors of the lower fire chamber remain clear for excellent observation of the fire and this controlled air flow continues on into the base of the fire to keep it burning quite uniformly.

I claim:

1. A fireplace cooking range and room air heater, comprising the assembly of:

(a) a fire chamber having front entry doors, left, right, and back side walls, a stainless steel bottom, and an open top;

(b) a cooking range-air heater located above the fire chamber having front entry doors, left, right, and back side walls, a bottom, and a closed top sloping downwardly to the rear, and being narrower in width than the fire chamber; and being shorter in length in extending to the rear, than the length of the fire chamber;

(c) surrounding walls extending directly up from the left, right, and rear side walls of the fire chamber to a height above the cooking range-air heater, forming passageways along the left, right, and rear sides of the narrower and shorter cooking range-air heater;

(d) a top enclosure secured to the surrounding walls and slopingly spaced above the closed top of the cooking range-air heater, and having a top opening for receiving a flue;

(e) a flue for directing the gaseous combustion products coming from the fire chamber up a chimney comprising, in turn; telescoping and clampable flue portions to adjust the overall flue length from the top of the top enclosure into the chimney of a dwelling fireplace to a height below the regular draft mechanism of the dwelling, which is thereafter left in the open position; a flange support selectively placed about the telescoping and clampable portions; and a non combustible mat of material supported on the flange support and extending in all horizontal directions to fully contact the interior walls of the chimney of a dwelling fireplace to seal any possible exit of room air which would otherwise flow upwardly in the chimney after passing by the exterior of this flue;

(f) a room air intake located below the entry doors of the cooking range-air heater and just above the top of front entry doors of the fire chamber;

(g) draft control located just inside the room air intake to guide room air down inside and alongside the closed entry doors of the fire chamber, thereby keeping soot and other particles from collecting on the inside surfaces of these closed entry doors, and keeping these closed entry doors cooler, and directing the room air down into the lower regions of the fire burning in the fire chamber to improve the combustion; and (h) spaced supports below the fire chamber raising the fire chamber above the hearth of a dwelling fireplace allowing room air to pass under the fire chamber, alongside the fire chamber, up the backside of the fire chamber, alongside the surrounding walls, across the top enclosure, and back into the room as heated air at a higher temperature.

* * * * *